United States Patent [19]

Ziemek et al.

[11] Patent Number: 4,760,692

[45] Date of Patent: Aug. 2, 1988

[54] DEVICE FOR THE STRANDING, OR STRANDING-ON, OF STRANDING ELEMENTS

[75] Inventors: Gerhard Ziemek; Friedrich Schatz; Lothar Werwitzke, all of Langenhagen, Fed. Rep. of Germany

[73] Assignee: kabelmetal electro Gesellschaft mit beschränkter Haftung, Hanover, Fed. Rep. of Germany

[21] Appl. No.: 25,612

[22] Filed: Mar. 13, 1987

[30] Foreign Application Priority Data

Mar. 19, 1986 [DE] Fed. Rep. of Germany ..... 3609146

[51] Int. Cl.[4] ..... D01H 9/00; D07B 3/00

[52] U.S. Cl. ..... 57/314

[58] Field of Search ..... 57/6, 16, 17, 18, 314, 57/58.3, 58.32, 58.52, 58.55, 59, 64

[56] References Cited

U.S. PATENT DOCUMENTS

| | | | |
|---|---|---|---|
| 1,518,253 | 12/1924 | Conner | 57/17 X |
| 1,934,025 | 11/1933 | Angell et al. | 57/16 |
| 2,659,192 | 11/1953 | Ripley | 57/314 |
| 4,689,943 | 9/1987 | Einsle et al. | 57/6 X |

*Primary Examiner*—Donald Watkins

*Attorney, Agent, or Firm*—Martin A. Farber

[57] ABSTRACT

In a device for the stranding or stranding-on of stranding elements to form a cable, stranding members of a stranding machine and storage receivers of the machine are combined to form a unit, and are present in duplicate to be interchangeable with each other. The unit with the storage receiver which has just been filled forms the active part and the other unit with the storage receiver which is to be filled forms the passive part in a stranding operation.

23 Claims, 5 Drawing Sheets

DEVICE FOR THE STRANDING, OR STRANDING-ON, OF STRANDING ELEMENTS

FIELD AND BACKGROUND OF THE INVENTION

The present invention relates to a device for the stranding, or stranding-on, of stranding elements of a cable, which device comprises a driveable stranding member and storage receivers for the stranding elements.

Devices of this type are already known, for instance as so-called basket stranding machines, i.e. stranding machines in which storage bobbins are conducted on a path which is concentric to the axis of the machine and/or to the movable cable core, and wherein the stranding elements come from storage bobbins to be brought together at a stranding point (stranding nipple). Another known type of stranding-on, for instance for stranding individual wires on a continuous cable core, has a tangential arrangement of the storage bobbins (European Patent A1 0166484).

These known systems have the disadvantage of relatively long set-up times for replacement of the full storage bobbins or drums by empty ones, the need for additional operating personnel, as well as a lesser flexibility in the use of the machine devices.

SUMMARY OF THE INVENTION

The invention is therefore based on an object of finding a possibility of arriving at higher machine outputs by reducing the set-up times and increasing the speed of production and, in addition, of making it possible to adapt existing machine equipment to the desires of customers.

This object is achieved in accordance with the invention in the manner that the stranding member and the storage receivers are combined to form a unit, are present in duplicate, and are exchangeable for each other, one unit having the storage receivers which have just been filled forming an active part of the stranding device while the other unit having the storage receivers which are to be filled forming a passive part of the stranding device. Such a device is equally suited for the stranding of individual stranding elements and for the stranding of plies on elongated material. The individual units are compact systems which, after a storage space has become empty, can be filled again in a short time. The filling itself can be effected in accordance with orders received, i.e. the storage receivers are filled with stranding elements of different or identical length and/or cross section and/or material in accordance with a predetermined program.

In the carrying out of the invention the stranding member can be of annular form for bearing storage receivers which are distributed over its periphery. Since, with this annular arrangement, large masses are to be moved, it is preferred, in a further development of the invention, to adopt an arrangement in which the stranding member is concentric to the storage receivers and spaced three-dimensionally therefrom. In this connection, the storage member can have the shape of a driveable tube or yoke within which the storage receivers are arranged with their axes parallel to the longitudinal axis of the tube or yoke.

The storage receivers are advantageously mounted for rotation on a shaft which is concentric to the tube or yoke, the shaft being adapted to be driven. For the transmission of force from the shaft to the storage receivers, coupling elements are employed. As coupling elements, known types can be employed; friction couplings, for instance, have proven suitable.

A particularly advantageous embodiment of the invention is obtained if the stranding member includes guide disks which can be jointly driven and are mounted in axial direction between individual storage receivers. If these stranding members serve simultaneously for the guiding of the stranding elements from or into the storage receivers, then easy removal results, even in the case of a plurality of receivers arranged one behind the other. There also results a facile filling of the receivers after the replacement of the units consisting of stranding members and storage receivers.

As already stated, it is important for the invention that the units which consist of stranding members and stranding receivers be interchangeable. In order to assure a favorable course of manufacture, it may frequently be advisable to arrange the units so that they are swingable in a turret-like manner. This means that while the one unit is connected actively in the course of manufacture, the other unit is being loaded with new stranding elements at a suitable loading station. After the removal of the stranding elements from the initially active unit, said unit is swung out of the operating position into the loading position and the loaded unit is conversely swung back into the operating position. Such an arrangement and turret-like swinging is particularly advantageous where space is limited.

As a further embodiment of the invention, however, one can also proceed in the manner that the units formed of stranding members and storage receivers are tiltable with respect to each other. For this purpose, for example, the two units can be arranged one behind the other in axial direction, the facing ends of these units being fastened in tiltable or turnable-tiltable manner. Such an arrangement has furthermore the additional advantage that the two units can be connected one behind the other so that stranding or stranding-on in layers is also possible in the same operation.

If the stranding member has advantageously the shape of a tube or yoke, then a second tube or yoke can be arranged concentrically to the fist tube or yoke, a number of storage receivers being associated with such second tube or yoke. In this way also there can be obtained a multi-layer stranding, it being possible, by selection of different directions of rotation and/or different speeds of rotation, to produce layers or stranding elements of most different types.

The decisive factor for rational manufacture with high machine outputs is, among other things, also that the centrifugal forces upon the rotation of the driven masses be kept as small as possible. In this connection, is it particularly advantageous for the shaft which bears the storage receivers to be developed as a hollow shaft. In this case the storage receivers may consist of barrels, bobbins or the like containing the stranding elements, and also of a suitable laying device. Ordinary commercial drums or bobbins can be used as storage receivers, but in order to increase the storage capacity one will use drum-shaped or bobbin-shaped bodies in which the diameter of the core corresponds to at least twice the height of the winding space. Since several such shaped members are preferably present one behind the other or in an annular arrangement in one unit, it has proven advantageous for these shaped members to be also interchangeable as a single set. This may be advisable for possible maintenance or repair work; interchangeability of the entire set of bobbins can, however, also be advantageous for rapid loading of the empty receivers.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENTS

Figure 1:
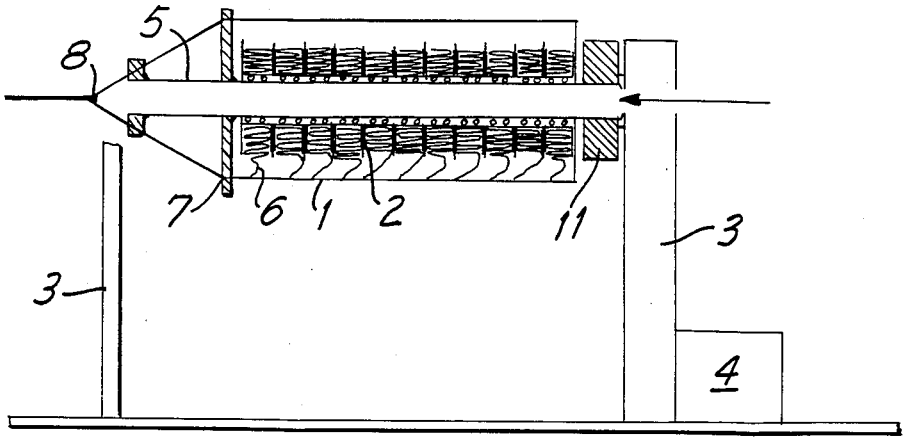
FIGS. 1 and 2 show, respectively, side and top views of the stranding device in the invention.
Figure 2:
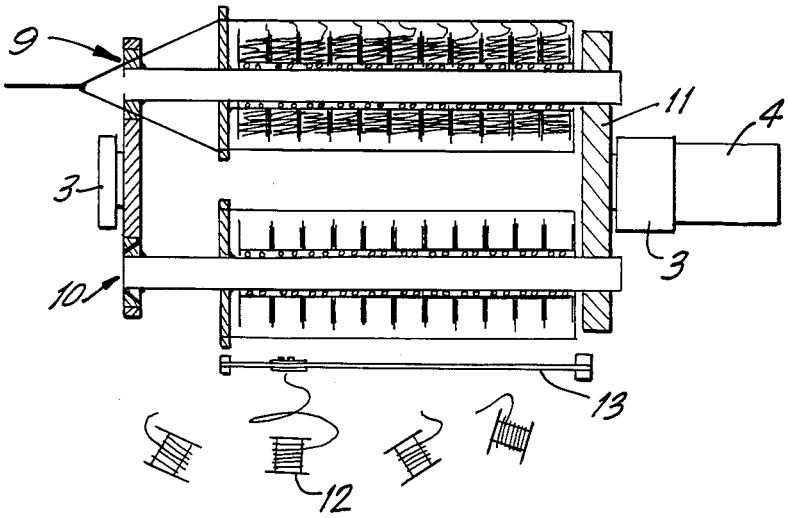

FIGS. 1 and 2 show, in side view and top view respectively, a device for the stranding or stranding-on of stranding elements in which stranding member and storage receivers are combined to form a unit and are present in duplicate.

As stranding member there is employed a tube 1 which is concentric to storage receivers 2 and rotates around them. For mounting, a stand 3 is employed; a driving is effected via gearing 4 while a hollow shaft 5, which may rotate freely, is used to receive the storage bobbins 2. Upon rotation of the tube 1, stranding elements 6 such as individual wires which are guided in or on the tube, for instance are withdrawn from the storage receivers 2, as shown, and, after deflection by a guide disk 7, are fed to stranding point 8. If the stranding elements 6 are not to be stranded together but are to be stranded over a cable core, then the cable core itself is conducted, as indicated by the arrow, through the hollow shaft 5 to the stranding point 8.

As can be noted from the top view of FIG. 2, two devices 9 and 10 consisting of stranding members and storage receivers are arranged alongside each other, possibly in the same plane. The construction of these units is identical; via a suitable change-over device 11 the two units 9 and 10 can be interchanged by swinging to each other. This swinging is advisedly effected in turret-like manner, which means in this specific case that after the emptying of the storage receivers 2, the unit 9 is swung out of the operating position and at the same time the unit 10 is brought back into a operating position. For the filling of the unit 9 which has been swung with empty storage receivers out of the operating position, there is used a loading station 12 in which stranding elements such as wires, by way of example, which may be of different dimensions are present in a suitable magazine and are introduced in accordance with a program by a diagrammatically indicated laying device 13 into the storage receivers 2. The loading process can also take place automatically in the same way as the corresponding swinging of the units into the loading and/or operating position.

Figure 3:
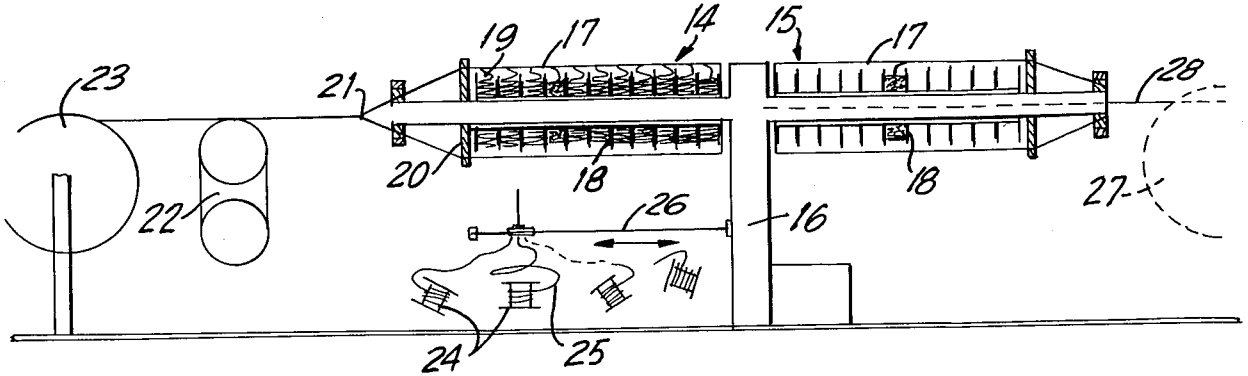
FIG. 3 shows side view of an alternative embodiment of the stranding device.

Differing from the embodiments of FIGS. 1 and 2, FIG. 3 shows an arrangement in which two units 14 and 15 are arranged with their ends facing each other and swingable around a stand 16. These units also consist advantageously of a rotating tubular stranding member 17 which serves simultaneously for guiding the stranding elements, the stranding member 17 being positioned concentric to storage bobbins 18 and rotating around them. The stranding elements pulled off from the storage 18, for instance metal wires 19, are fed via a guide disk 20 to a stranding point 21. The resulting stranded strand is then fed via guide rollers 22 to a storage drum 23.

When the supply of stranding elements 19 has been removed from the storage receivers 18, the unit 14 is brought into the loading position and the unit 15 is swung back into a operating position. For the loading of the storage receivers 18, there are provided diagrammatically indicated storages 24 from which stranding elements 25 can be removed and introduced into the storage receivers via laying device 26.

The arrangement shown in FIG. 3, however, also permits still another variant. Thus the two units 14 and 15 can also be installed fixed in space. For the loading of the unit 14 or 15, the loading station 24 is then pushed parallel to the units, as indicated by arrows and brought into the corresponding loading position. This arrangement has the advantage that, as shown in dashed line, a cable 28 is withdrawn from a cable delivery 27 and conducted through the unit 15 as well as the unit 14 to the winding drum 23. In station unit 15 and then unit 14 or else only in unit 15, one or more layers of wire can then be wound on. If several layers of wire are to be applied one after the other, then it is also possible to have the units 14 and 15 rotate with different speed of rotation and/or a different direction of rotation. If the two units travel in the same direction and with the same speed of rotation then particularly thick wrappings on the cable can be obtained which passes through.

Figure 4:
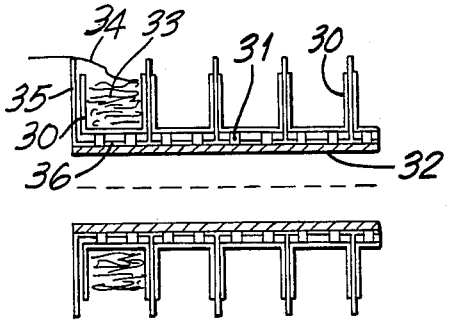
FIGS. 4 and 5 show enlarged views of storage receivers including bobbins for the stranding devices of FIGS. 1–3.
Figure 5:
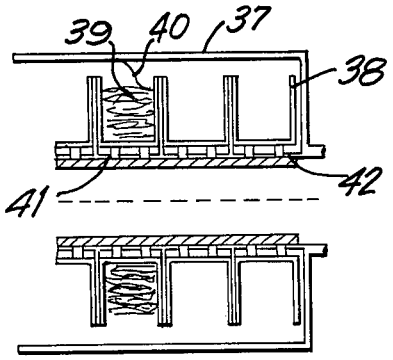

FIGS. 4 and 5 show, on a scale larger than FIGS. 1 to 3, the arrangement of the storage receivers, and particularly the storage bobbins, on a stand pipe or hollow shaft.

In FIG. 4 the individual bobbins 30 are mounted alongside each other via ball bearings 31 on the hollow shaft 32. The wires 34 withdrawn from the supply 33 are deflected in direction towards the stranding point by means of guide disks 35 and are thus guided at the same time. However, the same guidance serves also upon the loading of the storage bobbins 30 in the loading station to a dependable laying of the wires 34 in the bobbin 30. A coupling 36 enables the bobbins 30 to be firmly locked on the hollow shaft 32, for instance upon the stranding or stranding-on process, the coupling 36, however, also enabling the storage bobbins to rotate around the hollow shaft when the empty bobbins 30 are to be again filled with wires 34 in a loading station.

Differing from the embodiment shown in FIG. 4 in which the guide disks 35 form practically an open grid for the guiding of the wires 34, FIG. 5 shows an embodiment in which a guide tube 37 rotates concentrically to bobbins 38 which contain a supply of wire 39. Instead of a closed tube 37 it is, of course, also possible to develop the wire guide in the form of a grid on which, for instance, guide eyes or guide tubes are provided for the wire 40 withdrawn from the bobbins 38. As in the embodiment shown in FIG. 4, the bobbins 38 are rotatably mounted via ball bearings 41 on the rotating or fixed hollow shaft 42. The hollow shaft 42 is driven when the bobbins 38 are being loaded with a new supply of wire 39; it is stationary when the wires 40 are being withdrawn from the bobbins 38 and stranded together.

Based on the embodiments of FIGS. 1 to 3, FIG. 6 shows as illustrative embodiment a device 45 for the stranding or stranding-on of stranding elements, in which each unit which comprises stranding member and storage receiver is itself formed of two storage receivers and, in each case, two stranding members. In this case, two stranding members 48 and 49 arranged concentrically to each other are mounted on a stand 46 which has a drive 47. The stranding member 48 contains bobbins or storage receivers 50 while the storage bobbins 51 are associated with the stranding member 49. In the case shown, the wires 52 are withdrawn from the bobbins 50 and fed, via the stranding member 48, to a stranding point 53 for stranding. Concentrically to this, the wires 54 are withdrawn from the bobbins 51 and fed, deflected by suitable guide elements on the stranding member 49 and by a guide disk 55, to a stranding point 56. As can be seen, in this way a layer stranding of the individual elements can be obtained, but it is also possible, as can also be noted from FIG. 6, to apply concentric layers of the wires 52 and 54 on an electric cable 57 which is introduced. With this arrangement, it may also be advantageous if the stranding members 48 and 49, which are concentric to each other, rotate with a different speed of rotation and/or direction of rotation so that the concentric layers of wire can be applied to the cable with different direction of lay and/or pitch.

Figure 6:
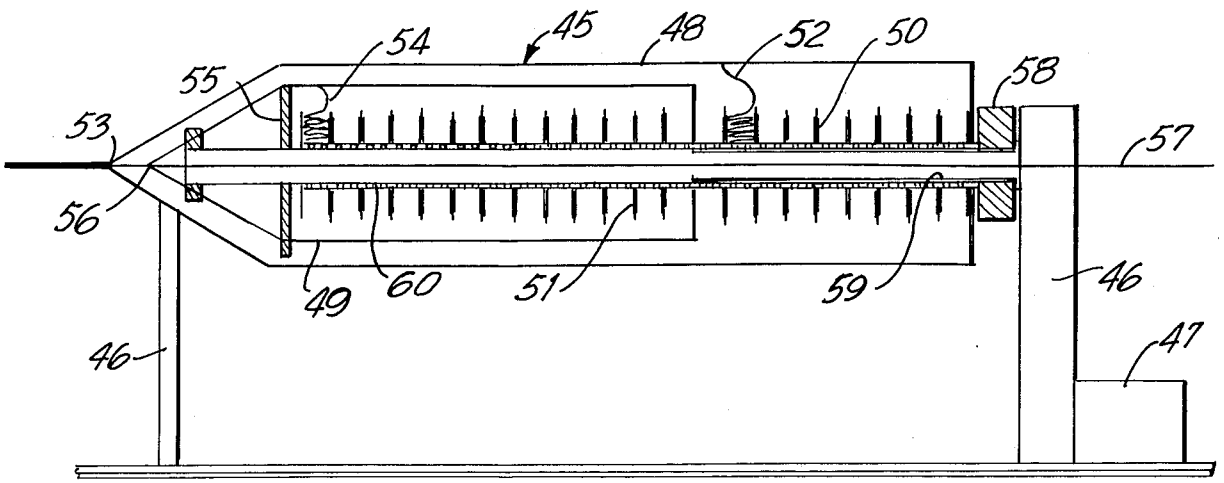
FIG. 6 shows a side view of a further embodiment of the invention.

The embodiment shown in FIG. 6 includes, for instance, a correspondingly developed second variant (not shown) wherein the two units lie alongside each other, for instance, in a plane, and can be swung by means of a diagrammatically indicated turning device 58 in each case into the operating position or, as shown, into a loading position. In the case shown, the storage bobbins 50 are rotatably mounted via ball bearings on the hollow shaft 59 and the storage bobbins 51 on the hollow shaft 60.

Figure 7:
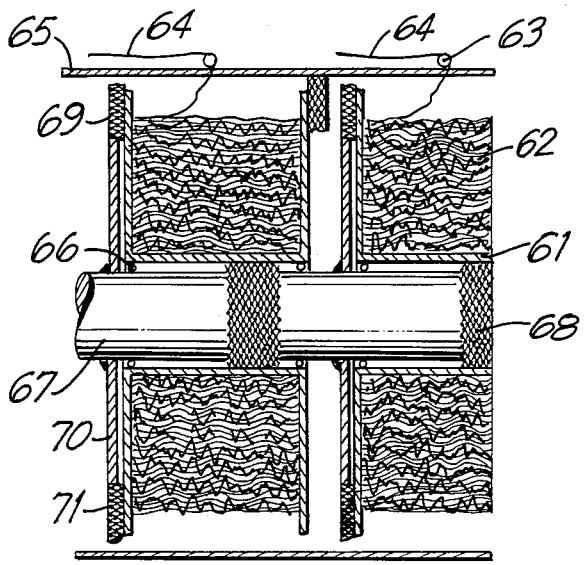
FIG. 7 shows an enlarged view of a mounting of the storage receivers.

FIG. 7 shows, on a scale larger than that of FIGS. 4 and 5, the mounting of the storage receivers, for instance bobbins on the solid or hollow shaft of the stranding device. The bobbins are in this case designated 61; they contain a wire supply 62; the wire withdrawn over individual guide rollers 63 is designated 64. The stranding member 65 consists of a tube rotating concentrically to the bobbins 61 or else a suitable yoke. The bobbins 61 are mounted via ball bearings 66 on a solid or hollow shaft 67. If the corresponding unit consisting of stranding member and stranding receivers is brought into the operating position, then the stranding member 65 rotates around the bobbins 61 and the wires 64 are thereby withdrawn in the direction indicated by the arrow. The storage receivers can in this case be arranged rotatably on the hollow or solid shaft 67 and thus automatically move around the shaft while the wires are withdrawn. However, the storage bobbins 61 can also be held fast on a hollow or solid shaft 67 in the operating condition of the stranding device by means of couplings 68 and/or 69. Another possibility for regulating the speed of rotation of the co-rotating storage bobbins 61 is to provided additional flanges 70 which are equipped with a braking device 71 on the surfaces thereof facing the bobbins 61.

Upon considering the situation in which a stranding member and the storage receivers associated therewith are swung, turn or tilted into the loading position after the stranding process and the unloading of the storage bobbins, then it must be ascertained, by adjustment of the couplings or brakes, that the bobbins are firmly locked on the hollow or solid shaft 67 upon the driving of said shaft.

The bobbins 61 which, as a rule, are not ordinary commercial bobbins but rather chambers, can be filled with the individual wires. In particular, and for purposes also of rational manufacture it may, however, at times be advantageous to introduce, instead of a single wire, a plurality of wires simultaneously into the bobbin upon the loading process and pull them out from same again in the operating condition. A plurality of these wires can be introduced into and removed from the storages simultaneously alongside of each other but one can also use wires which are already plied or even stranded or twisted together and introduce this element into the storage receivers and strand them together or ply them as concentric layers onto strand-shaped material.

The loading of the bobbins or storage receivers can be controlled in accordance with the orders received. In response to a suitable command the empty storage receivers can, for instance, be filled with stranding elements for a cable B while the last length of the cable A is still being produced. In this way a computer-compatible flexible mode of manufacture is obtained.

In this connection it is also essential that the stranding elements such as wires required for the next operation, are made available in a loading station under computer control for the unit which has been swung out of the operating position, after such wires have been taken, for instance, from a main storage. The pass-through time for the material upon the manufacture of strandings or strandings-on can thus be further reduced.

We claim:

1. A device for stranding or stranding-on, of stranding elements of a cable, comprising a driveable stranding member and storage receivers for the stranding elements; and wherein the stranding member and the storage receivers are constructed as a unit, there being two such units, the two units being interchangeable; and wherein one of said units has storage receivers which have just been filled to serve as an active part of the device, and the second of said units has storage receivers which are to be filled to serve as a passive part of the device; said device further comprising means for interchanging one of said units with the other of said units during a stranding operation.

2. A device according to claim 1, wherein a stranding member is of annular form and bears storage receives which are distributed on its periphery.

3. A device according to claim 1, wherein a stranding member is positioned concentrically to the storage receivers and spaced apart from them.

4. A device according to claim 3, wherein the stranding member has the shape of a driveable yoke including a tubular yoke, within which stranding member the storage receivers are arranged with their axes parallel to a longitudinal axis of the yoke.

5. A device according to claim 3, further comprising a shaft arranged concentrically to the yoke; and wherein the storage receivers are rotatably mounted on said shaft.

6. A device according to claim 5, wherein the shaft is located in the device for receiving power so as to be driven.

7. A device according to claim 5, further comprising coupling elements which serve to transmit force form the shaft to the storage receivers.

8. A device according to claim 4, further comprising a shaft arranged concentrically to the yoke; and wherein the storage receivers are rotatably mounted on said shaft.

9. A device according to claim 8, wherein the shaft is located in the device for receiving power so as to be driven.

10. A device according to claim 9, further comprising coupling elements which serve to transmit force form the shaft to the storage receivers.

11. A device according to claim 3, wherein a stranding member comprises guide disks which can be driven in common and are mounted axially, respectively, between individual storage receivers.

12. A device according to claim 3, wherein the stranding members serve for guiding stranding elements relative to the storage receivers.

13. A device for stranding or stranding-on, of stranding elements of a cable, comprising a driveable stranding member and storage receivers for the stranding elements; and wherein the stranding member and the storage receivers are constructed as a unit, there being two such units, the two units being interchangeable; and wherein one of said units has storage receivers which have just been filled to serve as an active part of the device, and the second of said units has storage receivers which are to be filled to serve as a passive part of the device; and wherein each of the units formed of stranding member and stranding receivers is disposed swingably in the manner of a turret.

14. A device for stranding or stranding-on, of stranding elements of a cable, comprising a driveable stranding member and storage receivers for the stranding elements; and wherein the stranding member and the storage receivers are constructed as a unit, there being two such units, the two units being interchangeable; and wherein one of said units has storage receivers which have just been filled to serve as an active part of the device, and the second of said units has storage receivers which are to be filled to serve as a passive part of the device; and wherein the units formed of stranding member and storage receivers are tiltable with respect to each other.

15. A device for stranding or stranding-on, of stranding elements of a cable, comprising a driveable stranding member and storage receivers for the stranding elements; and wherein the stranding member and the storage receivers are constructed as a unit, there being two such units, the two units being interchangeable; and wherein one of said units has storage receivers which have just been filled to serve as an active part of the device, and the second of said units has storage receivers which are to be filled to serve as a passive part of the device; and wherein a stranding member has the form of a yoke including a tubular yoke, there being a second yoke disposed concentrically to the first-mentioned yoke, a plurality of storage receivers being associated with said second tube or yoke.

16. A device according to claim 15, wherein said yokes are arranged concentrically about a longitudinal axis of the device, the concentric yokes being driveable with different speeds of rotation and/or directions of rotation.

17. A device according to claim 5, wherein a shaft bearing the storage receivers is formed as a hollow shaft.

18. A device for stranding or stranding-on, of stranding elements of a cable, comprising a driveable stranding member and storage receivers for the stranding elements; and wherein the stranding member and the storage receivers are constructed as a unit, there being two such units, the two units being interchangeable; and wherein one of said units has storage receivers which have just been filled to serve as an active part of the device, and the second of said units has storage receivers which are to be filled to serve as a passive part of the device; and wherein the unit forming the passive part is tiltable from an operating position of the active unit to a loading station having a supply of stranding elements.

19. A device according to claim 18, wherein the loading station is displaceable along the unit which forms the passive part.

20. A device according to claim 18, wherein a storage receiver comprises barrels, bobbins and the like for holding the stranding elements, a storage receiver further comprising a laying device.

21. A device according to claim 1, wherein the storage receivers are drums or bobbins.

22. A device according to claim 1, wherein the storage receivers are drum-shaped or bobbin-shaped members having diameter of core which is at least twice the height of a winding space.

23. A device according to claim 1, wherein the storage receivers in each of the units are arranged side-by-side to allow control of a loading of the storage receivers by a computer command.

* * * * *